US005469509A

United States Patent [19]

Navone et al.

[11] Patent Number: 5,469,509

[45] Date of Patent: Nov. 21, 1995

[54] CAR AUDIO SYSTEM WITH HIGH SIGNAL OUTPUT

[75] Inventors: David Navone, Stockton, Calif.; Richard L. Clark, Burlington, N.C.

[73] Assignee: Monster Cable International, Ltd., South San Francisco, Calif.

[21] Appl. No.: 175,928

[22] Filed: Dec. 30, 1993

[51] Int. Cl.[6] ..... H04S 1/00

[52] U.S. Cl. ..... 381/28; 381/24

[58] Field of Search ..... 381/24, 28, 86, 381/89; 330/295, 124 R

[56] References Cited

U.S. PATENT DOCUMENTS

| | | | |
|---|---|---|---|
| 3,992,590 | 11/1976 | Takahashi et al. | 179/15 BT |
| 4,204,092 | 5/1980 | Bruney | 381/24 |
| 4,239,937 | 12/1980 | Kampmann | 179/1 G |
| 4,791,381 | 12/1988 | Lenz | 330/84 |
| 4,815,133 | 3/1989 | Hibino | 381/24 |
| 4,837,825 | 6/1989 | Shivers | 381/24 |
| 5,051,708 | 9/1991 | Boezen et al. | 330/297 |
| 5,075,634 | 12/1991 | French | 330/146 |
| 5,157,347 | 10/1992 | Geerdink et al. | 330/260 |
| 5,243,656 | 9/1993 | Tanida et al. | 381/24 |
| 5,333,200 | 7/1994 | Cooper et al. | 381/24 |

OTHER PUBLICATIONS

Introduction, New Data Book Format, National's Linear Data Book, p. iii, LM380 Audio Power Amplifier General Description, pp. 10–41, 10–44, 1976.

*Primary Examiner*—Stephen Brinich

*Attorney, Agent, or Firm*—Warren B. Kice

[57] ABSTRACT

A circuit for coupling a 2- or 4-channel audio deck to 2- or 4-speakers in a car stereo audio system to increase the signal level output without raising the supply voltage or increasing the noise. The circuit comprises unity gain inverting and non-inverting amplifiers each connected in one of four channels, with the outputs combined to provide left and right channel outputs for series connection, respectively, to the left and right channel speakers.

17 Claims, 3 Drawing Sheets

CAR AUDIO SYSTEM WITH HIGH SIGNAL OUTPUT

This invention relates to car audio systems, and in particular to audio circuitry for increasing the signal-to-noise (S/N) ratio of the audio signal output.

BACKGROUND OF INVENTION

Successfully installing car audio components into a vehicle can be difficult given the fact that the chassis of the car is used as a ground return for virtually all of the car's electrical accessories. The car's alternator and electrical accessories cause large changes in the magnetic fields surrounding the accessory power and control leads as well as the car's chassis. As a signal is routed from component to component, noise can be introduced into the system due to the proximity of the signal route to changing electro-magnetic fields. Also, noise can be introduced into components via the power supply or internal signal paths. One method of handling a signal in hostile noisy environments is to increase the level of the signal so that the noise will be small in comparison, i.e., increase the S/N ratio by increasing the signal level.

To be effective, an increase in the level of the signal must be at the source. Increasing the signal level after the source would also increase the noise floor. In car audio, the source is commonly called the deck or headpiece. Decks usually have four signal outputs for feeding a 4-speaker stereo system in the car; the name assigned to the output describes the speaker position within the car, namely: for the left channel (LC), left front (LF), and left rear (LR); for the right channel (RC), right front (RF) and right rear (RR). The maximum signal level output of most decks is approximately 2.0 volts rms (root mean square)—approximately 5.6 volts peak-to-peak. This is because virtually all modern vehicles operate on a nominal 12.0 volts DC and therefore the circuitry in virtually all modern car audio decks also operates on a nominal 12.0 volts DC. Once this 12.0 volt level is regulated and connected to the audio circuitry in a deck, the highest signal level attainable is only around 2.0 volts. This is because of voltage drops within the semiconductor devices of the deck. So if the audio circuitry within the deck is operating on 12.0 volts DC, the signal level will be around 2.0 volts rms.

One popular technique to increase the signal output level is to convert the car's nominal 12.0 volts DC into higher levels such as 20 volts or even 30 volts so that the pre-amp level output stages can accommodate higher signal levels. The power supply convertors necessary to increase the 12.0 volts, however, makes these decks expensive.

SUMMARY OF THE INVENTION

An object of the invention is a car audio system with a high signal output.

Another object of the invention is a low cost, car, stereo audio system with an improved S/N ratio.

A still further object of the invention is a car audio system employing a deck with four signal outputs for feeding four speakers in the car and having an increased signal output without a corresponding increase in the noise level.

The invention is based on several concepts. First, it was recognized that, to avoid undue expense, it was necessary to maintain the car's nominal 12.0 volt supply. Second, it was recognized that just adding amplifiers to the system would have the same effect on both the signal as on the noise, therefore preventing an increase in the S/N ratio. Third, it was recognized that any increase in the S/N ratio should not be obtained at a sacrifice of the other desirable qualities of a car audio system, such as frequency response and distortion.

In accordance with one aspect of the present invention, in a car audio system employing a deck with four signal outputs for feeding four speakers, a coupling circuit is employed for connecting the four deck outputs to the inputs of the next stage, which can be a conventional equalizer, electronic crossover, or amplifier, whose output will in turn be connected to the four speakers. The coupling circuit has only two outputs, one for the left channel (LC) and one for the right channel (RC), with the RF and RR speakers connected to the RC output and the LF and LR speakers connected to the LC output. Thus, the LF and LR channels are combined into one LC, and the RF and RR channels are combined into one RC. The result is a 6 dB increase in signal level, without a corresponding 6 dB increase in the noise level.

In accordance with another aspect of the invention, the coupling circuit of the invention comprises unity gain buffer amplifiers. This ensures no signal losses while preventing any increases in the noise level.

We have found that applying the coupling circuit of the invention to a car audio system using the normal 12.0 volts power supply will convert the signal output level of a typical 1.8 volt rms deck into a 3.6 volt rms deck. In addition, the thus improved system offers the benefits of lower inductive noise, lower system noise, and less system hiss, while maintaining a frequency response of ±0.05 dB from 20 Hz to 20 KHz, a distortion less than 0.01% throughout, and a S/N ratio in excess of 120 dB.

The coupling circuit of the invention provides the maximum benefits when used with the conventional 4-channel deck, but can also used with 2-channel decks, but since the noise entering the circuit will be correlated, the noise floor may increase.

The above and further objects, details and advantages of the present invention will become apparent from the following detailed description of preferred embodiments thereof, when read in conjunction with the accompanying drawings.

DETAILED DESCRIPTION OF PREFERRED EMBODIMENTS

Figure 1:
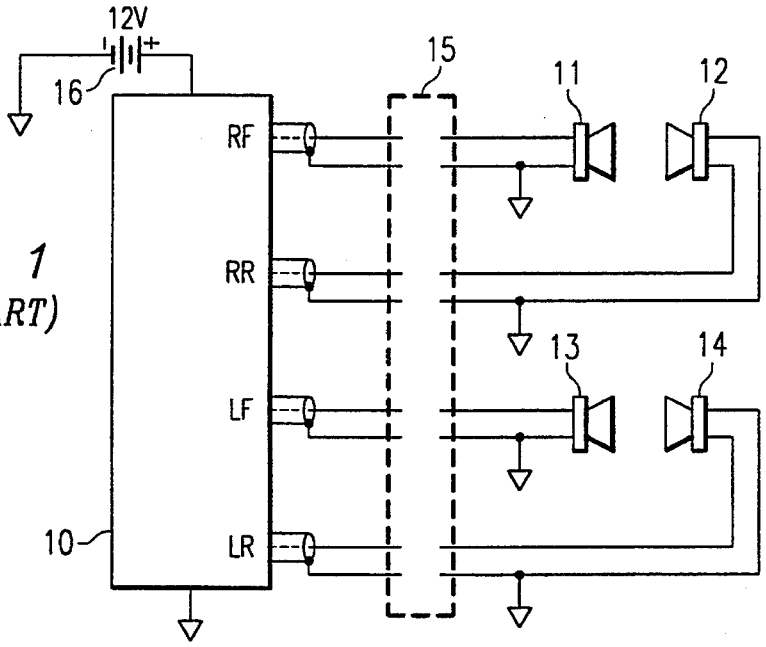
FIG. 1 (PRIOR ART)
FIG. 1 is a schematic of a conventional car audio system using a 4-channel deck.

FIG. 1 schematically illustrates a conventional car audio system having 4-channel outputs from a deck 10 for feeding four speakers 11–14. The deck 10 has four jacks labelled RF for the right front channel, RR for the right rear channel, LF for the left front channel, and LR for the left rear channel. The L and R stand for the conventional L and R channel output for a stereo system. The signal outputs at the RF and RR jacks are in phase, as are the signal outputs at the LF and LR jacks. Cables connect each of the jacks via a conventional equalizer, electronic crossover, or amplifier 15 to their respective speakers; thus, the RF jack to the RF speaker 11, the RR jack to the RR speaker 12, the LF jack to the LF speaker 13, the LR jack to the LR speaker 14. As is common, the deck power supply is the usual car 12.0 volt power source 16. For the typical transistorized deck, the signal output level at the jacks is about 1.8 rms volts maximum.

Figure 2:
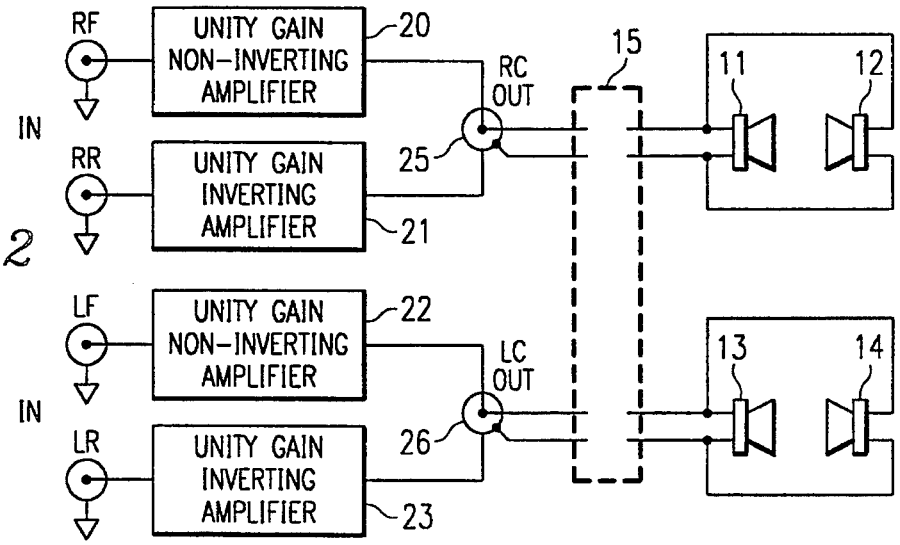
FIG. 2 is a schematic of one form of coupling circuit of the invention.

FIG. 2 is a schematic illustrating the basic circuit of the coupling circuit of the invention. Similar reference numerals are used in FIG. 2 and the other figures for elements similar to those used in FIG. 1. The input jacks labelled RF, RR, LF and LR are connected by cables to the correspondingly labelled output jacks of the deck 10. However, the circuit includes, before the next stage 15, four unity-gain amplifiers 20–23, two of which 20, 22 are non-inverting and two of which 21, 23 are inverting. Two output jacks 25, 26 are connected as shown. In particular, the central conductor of the RF input jack is connected to the non-inverting amplifier 20 whose output is connected to the central conductor of the RC output jack 25, whereas the central conductor of the RR input jack is connected via the inverting amplifier 21 to the shield of the RC output jack 25. The LF and LR inputs are similarly connected via the amplifiers 22 and 23 to the LC output jack 26. Thus, what was before four separate audio channels have been combined as shown into two left and right channels, effectively doubling the signal level at the respective output jacks 25 and 26. The latter can now be connected via the conventional next stage to the four speakers 11–14 as shown. In effect, both RC speakers 11, 12 are now in series with the RF and RR deck outputs, and both LC speakers 13, 14 are in series with the LF and LR deck outputs.

The unity-gain amplifiers which provide the right phasing of the signals without increasing the noise level can be obtained in various ways. One way, illustrated in FIG. 3 for just the RC, is to provide transformers 30, 31 for the RF and RR channels, with the transformer coils wound to provide non-inverting coupling for the RF channel and inverting coupling for the RR channel. The left channels would be similarly connected. Incidentally, it will be understood that in this as well as in the other embodiments, the amplifiers can be swapped, with the amplifier for the RR channel being non-inverting and that for the RF channel being inverting to provide the desired signal additive effect when series connected to a speaker. Transformer coupling is expensive, and operational amplifiers (Op-Amp) provide the same function but at much lower cost. One such embodiment is illustrated in FIG. 4.

Figure 4:
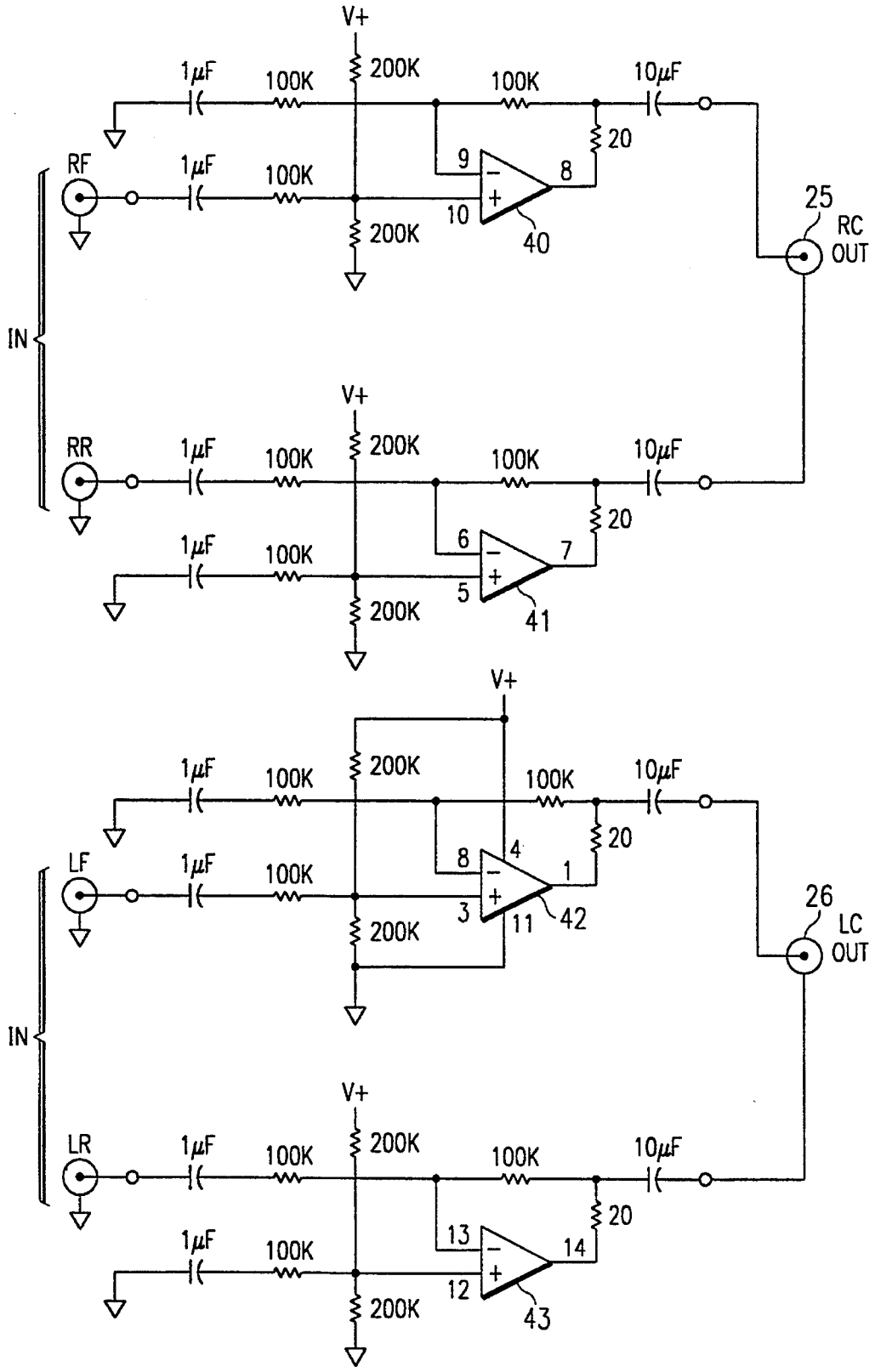
FIGS. 4 and 5 are schematics of still other forms of coupling circuits of the invention.

The circuit shown in FIG. 4 uses a conventional quad Op-Amp integrated circuit (IC) available commercially TL084 with four independent Op-Amps 40–43. Any other Op-Amp IC can be substituted. Connected to each one of the Op-Amps are the same external components to obtain a unity gain amplifier. The inverting or non-inverting function was achieved by coupling the input to either the non-inverting (+) input of the Op-Amp for the RF and LF channels or to the inverting (–) input for the RR and LR channels. The component values as an example have been shown in the drawing. The applied voltage (V+) was 12 volts DC. With an Op-Amp from a different supplier, other components values may be necessary. The Op-Amp IC suppliers typically provide sample circuits to achieve unity gain with their IC.

The circuit illustrated in FIG. 4 will provide all the benefits described above, including the doubled signal output at the RC and LC jacks 25, 26 with no loss in frequency response or distortion, and with a S/N ratio in excess of 120 dB. The output impedance of the circuit shown is around 100 ohms. The doubling of the signal level output permits a decrease in the input sensitivity of the next stage amplifiers 15. This will enhance the program material output with less hiss.

If the circuit of FIG. 4 were used with a 2-channel deck, conventional y-adapters should be installed between the two deck outputs and four circuit inputs of the coupling circuit of the invention.

The circuit of FIG. 4 can also be connected between any two pre-amp level components.

In the embodiments so far described, it will be understood that the coupling circuit is not connected directly to the speakers, but usually through another stage including buffers to actually drive the speakers. Hence, the use herein of the expression "connected to the speakers" should be understood to include an intervening conventional audio stage, such as an equalizer, electronic crossover, or amplifier.

Figure 5:
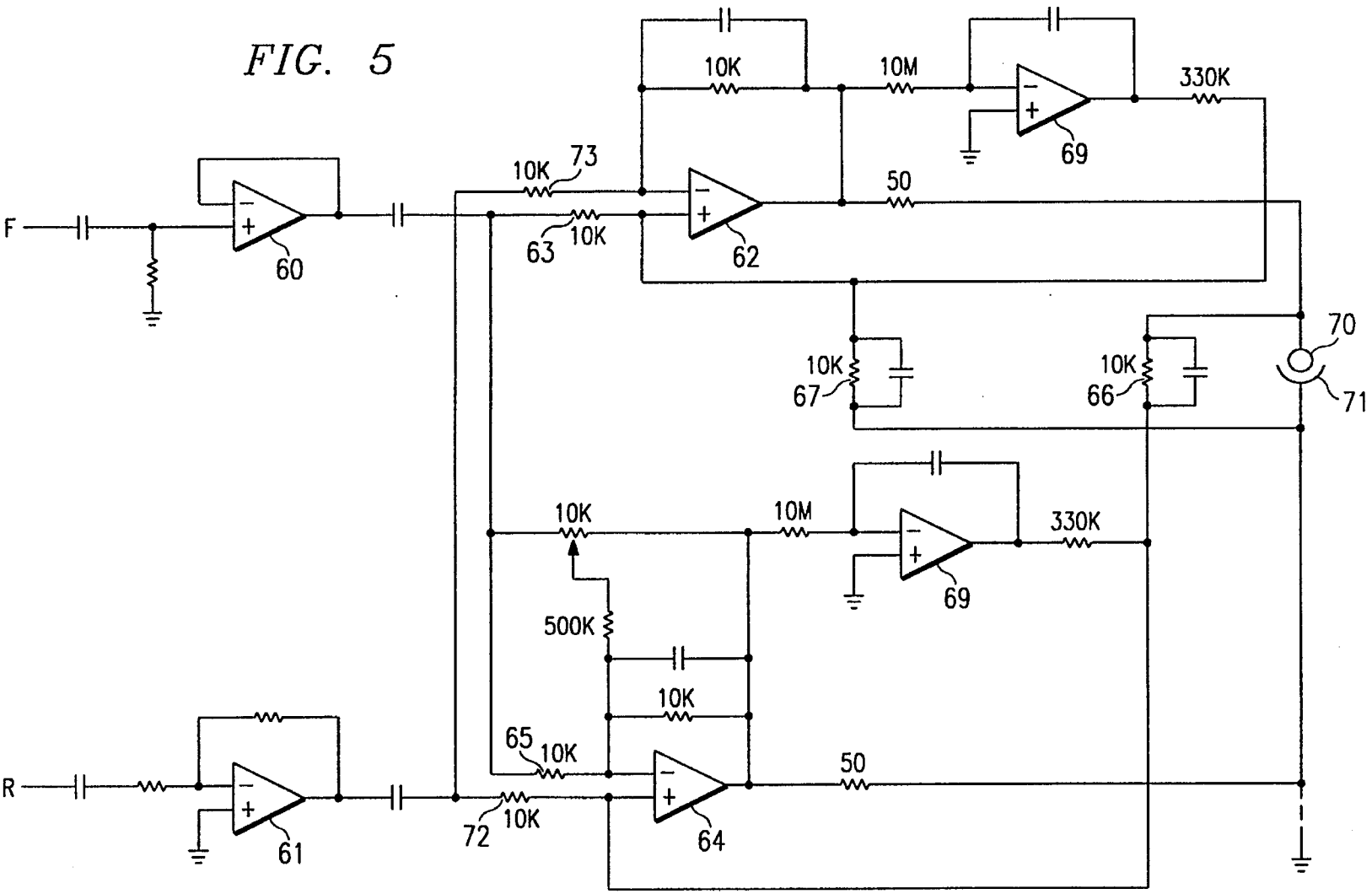

In the previous embodiments, whether with four or two inputs, the coupling circuit drives a conventional balanced output, i.e., the input to the following stage. In certain equipment, however, the input to the following stage is unbalanced, which means that the coupling circuit with a balanced input would be driving an unbalanced output. FIG. 5 is a block diagram of a modified coupling circuit to compensate for this unbalanced condition.

FIG. 5 illustrates one-half of the modification of the coupling circuit, i.e. the circuit for either the left or right channels. In this circuit, the right or left front signal is applied to a unity gain amplifier 60, and the right or left front signal is applied to the inverting unity gain amplifier 61. The output of the amplifier 60 is applied to the non-inverting input of a unity gain buffer amplifier 62 via input resistor 63, as well as to the inverting input of the unity gain buffer amplifier 64 via the input resistor 65. The output of amplifier 61 is applied to the non-inverting input of unity gain buffer 64 via input resistor 72, as well as to the inverting input of the unity gain buffer amplifier 62 via the input resistor 73. The output of the buffer amplifiers 62 is cross coupled to the non-inverting input of the buffer amplifier 64 via a resistor 66, and the output of the buffer amplifier 64 is coupled to the non-inverting input of the buffer amplifier 62 via the resistor 67.

Since the output of the buffer amplifier 64 is inverted, with respect to the input of the buffer amplifier 62, and since the output of the buffer amplifier 62 is inverted with respect to the input of the buffer amplifier 64, the two signals applied to each of the non-inverting inputs of these amplifiers cancel one another, so that the output of the respective amplifiers is responsive essentially only to the signals applied to the respective inverting input.

If the output lead of the amplifier 64 is grounded, as indicated by the dashed line connecting this output to ground, it is apparent that the signal that had been applied from this output line to the non-inverting input of the buffer amplifier 62 will be lost, and the signal applied from the amplifier 60 to the non-inverting input of the buffer amplifier 62 will no longer be canceled by the output signal of the buffer amplifier 64. Accordingly, the output of the buffer amplifier 62 will increase to the substantially double its former amplitude, to supply the output of the circuit, between terminals 70, 71 with a signal that is of substantially the same amplitude as it would be if the output of the amplifier 64 had not been grounded. It is apparent that the same effect is obtained if the output of the buffer amplifier 62 is grounded.

Figure 3:
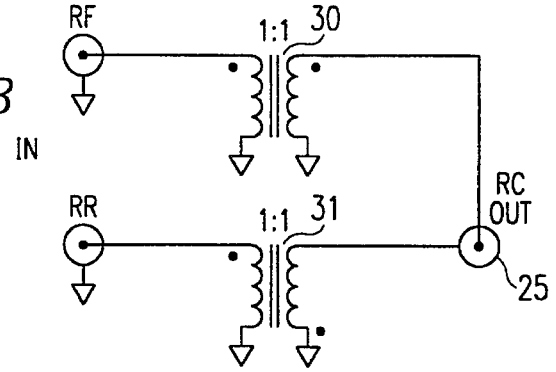
FIG. 3 is a schematic of part of another form of coupling circuit of the invention.

The circuit of FIG. 5 thus provides larger amplitude output signals in the manner illustrated in FIGS. 2–4 in the event that none of its output lines is grounded, and substantially maintains the output level even if either of the output lines is grounded.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. This scope of the invention is indicated by the appended claims rather than by the foregoing description.

What is claimed is:

1. A circuit for coupling an audio deck to a speaker system, said audio deck having at least a RC and a LC output coupled to provide first and second RC and third and fourth LC outputs, comprising:

(a) first non-inverting amplifying means, (b) second inverting amplifying means, (c) third non-inverting amplifying means, (d) fourth inverting amplifying means, (e) said amplifying means each having an input and an output, (f) means connecting the input of the first amplifying means to one of the first and second RC deck outputs and the input of the second amplifying means to the other of the first and second RC deck outputs, (g) means connecting the input of the third amplifying means to one of the first and second LC deck outputs and the input of the fourth amplifying means to the other of the first and second LC deck outputs, (h) said first and second amplifying means outputs cooperating to provide audio signals to at least one RC speaker, (i) said third and fourth amplifying means outputs cooperating to provide audio signals to at least one LC speaker.

2. The circuit of claim 1, further comprising a RC output jack having a central conductor and a shield, said central conductor being connected to one of the first and second amplifying means outputs, said shield being connected to the other of the first and second amplifying means outputs.

3. The circuit of claim 1, further comprising a LC output jack having a central conductor and a shield, said central conductor being connected to one of the third and fourth amplifying means outputs, said shield being connected to the other of the third and fourth amplifying means outputs.

4. The circuit of claim 1, wherein the amplifying means each comprise a unity gain amplifier.

5. The circuit of claim 4, wherein the amplifying means each comprise a 1:1 transformer.

6. The circuit of claim 4, wherein the amplifying means each comprise an Op-Amp.

7. An audio system comprising:

(I) a circuit for coupling an audio deck to a speaker system, said audio deck having at least a RC and a LC output coupled to provide first and second RC and third and fourth LC outputs, comprising:

(a) first non-inverting amplifying means, (b) second inverting amplifying means, (c) third non-inverting amplifying means, (d) fourth inverting amplifying means, (e) said amplifying means each having an input and an output, (f) means connecting the input of the first amplifying means to one of the first and second RC deck outputs and the input of the second amplifying means to the other of the first and second RC deck outputs, (g) means connecting the input of the third amplifying means to one of the first and second LC deck outputs and the input of the fourth amplifying means to the other of the first and second LC deck outputs, (II) (a) a RF speaker, (b) a RR speaker, (c) a LF speaker, (d) a LR speaker, (III) said RF and RR speakers being connected in series with the first and second amplifying means outputs, and said LF and LR speakers being connected in series with the third and the fourth amplifying means outputs.

8. The circuit of claim 7, further comprising a RC output jack having a central conductor and a shield, said central conductor being connected to one of the first and second amplifying means outputs, said shield being connected to the other of the first and second amplifying means outputs.

9. The circuit of claim 8, further comprising a LC output jack having a central conductor and a shield, said central conductor being connected to one of the third and fourth amplifying means outputs, said shield being connected to the other of the third and fourth amplifying means outputs.

10. The circuit of claim 7, wherein the amplifying means each comprise a unity gain amplifier.

11. The circuit of claim 10, wherein the amplifying means each comprise a 1:1 transformer.

12. The circuit of claim 10, wherein the amplifying means each comprise an Op-Amp.

13. The circuit of claim 10, further comprising means in the system for detecting the absence of a differential load and for providing differential inputs.

14. A circuit for coupling an audio deck to a speaker system for increasing the gain of the signal output from the deck while not increasing the noise of said signal a corresponding amount, wherein said audio deck has a RC and a LC output;

said circuit comprising:

(a) first non-inverting amplifying means, (b) second inverting amplifying means, (c) third non-inverting amplifying means, (d) fourth inverting amplifying means, (e) said amplifying means each having an input and an output, (f) means connecting the input of the first amplifying means to the RC deck output and the input of the second amplifying means to the RC deck output, (g) means connecting the input of the third amplifying means to the LC deck output and the input of the fourth amplifying means to the LC deck output, (h) said first and second amplifying means outputs cooperating to provide audio signals to at least one RC speaker, (i) said third and fourth amplifying means outputs cooperating to provide audio signals to at least one LC speaker.

15. The circuit of claim 14, further comprising a RC output jack having a central conductor and a shield, said central conductor being connected to one of the first and second amplifying means outputs, said shield being connected to the other of the first and second amplifying means outputs.

16. The circuit of claim 14, further comprising a LC output jack having a central conductor and a shield, said central conductor being connected to one of the third and fourth amplifying means outputs, said shield being connected to the other of the third and fourth amplifying means outputs.

17. The circuit of claim 14, wherein the amplifying means each comprise a unity gain amplifier.

* * * * *